United States Patent [19]

Eisenberg

[11] 4,142,560

[45] Mar. 6, 1979

[54] OPEN-TYPE FILLING MACHINE

[75] Inventor: Bernard C. Eisenberg, Rockaway, N.J.

[73] Assignee: Solbern Corp., Fairfield, N.J.

[21] Appl. No.: 876,108

[22] Filed: Feb. 8, 1978

[51] Int. Cl.[2] ..... B65B 1/20

[52] U.S. Cl. ..... 141/12; 141/72; 141/78; 141/115; 53/239

[58] Field of Search ..... 141/71, 72, 73, 74, 141/75, 76, 77, 78, 79, 80, 11, 12, 115, 129; 198/550, 557, 614, 954, 609; 53/239

[56] References Cited

U.S. PATENT DOCUMENTS

| | | | |
|---|---|---|---|
| 2,710,097 | 6/1955 | Bolles | 198/557 |
| 3,217,760 | 11/1965 | Eisenberg | 141/12 |
| 3,556,172 | 1/1971 | Mencacci | 141/11 |
| 3,877,585 | 4/1975 | Burgess | 214/17 CA |
| 3,903,941 | 9/1975 | Eisenberg | 141/78 |
| 3,905,326 | 9/1975 | Eisenberg | 141/78 |

FOREIGN PATENT DOCUMENTS

| | | | |
|---|---|---|---|
| 2064609 | 7/1972 | Fed. Rep. of Germany | 198/557 |

OTHER PUBLICATIONS

Soldbern—Open Type High Speed Pickle Packer, Technical Information and Basic Description.

Hughes—Model VF Vari-Flow Filler; Bulletin, No. 276 and No. 375.

Hughes—Oscillating Conveyors and Belt Conveyors, NEFP Convention Handout.

Hughes—Inspection Tables and DeWatering Unit, NEFP Convention Handout.

*Primary Examiner*—Richard E. Aegerter
*Assistant Examiner*—John W. Shepperd
*Attorney, Agent, or Firm*—Kenyon & Kenyon, Reilly, Carr & Chapin

[57] ABSTRACT

The disclosure relates to a machine which is adapted to fill a line of containers passing through a filling zone. The machine includes apparatus for delivering material to the containers which is arranged compactly yet is easily accessible for maintenance and cleaning. The material delivery apparatus includes a hopper located at the outlet end of the machine and an inclined endless belt conveyor extending upwardly from the hopper to a discharge location laterally spaced from and above the line of containers to be filled. The conveyor belt has flights which pick up portions of material from the hopper and deliver the portions to a shaker tray mounted for reciprocation offset and parallel to the line of containers. The shaker tray has a diagonal discharge edge for uniformly distributing an elongated flow of the material to a lower shaker tray mounted for reciprocation transversely to the line of containers. The lower shaker tray has a discharge edge positioned above and extending parallel to the line of containers in the filling region. The material descends in an elongated flow from the discharge edge of the lower tray and enters the open tops of the containers.

10 Claims, 6 Drawing Figures

10
11
12
13
14
15
16
17
18
19
20
21
22
23
25
26
27
28
29
30
31
32
33
34
35
39
40
44
48
58

Fig. 2.
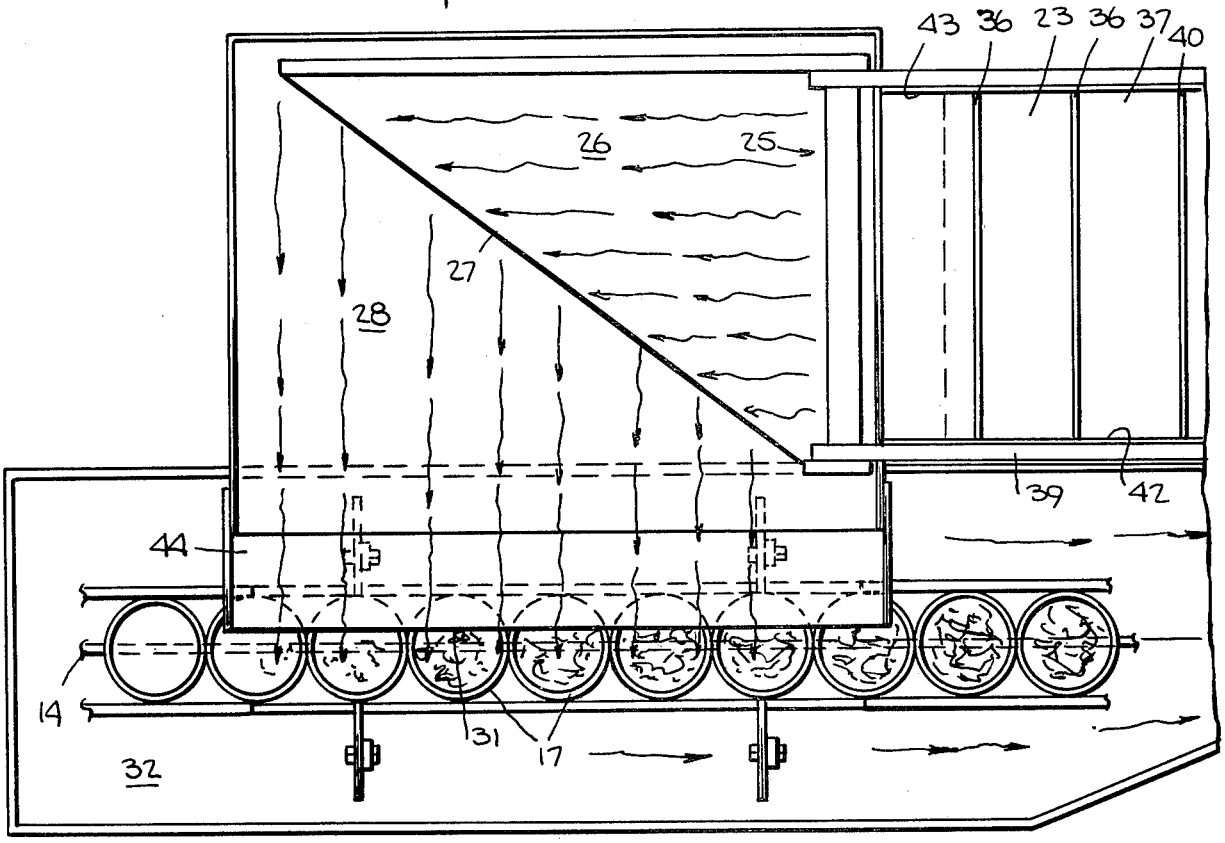
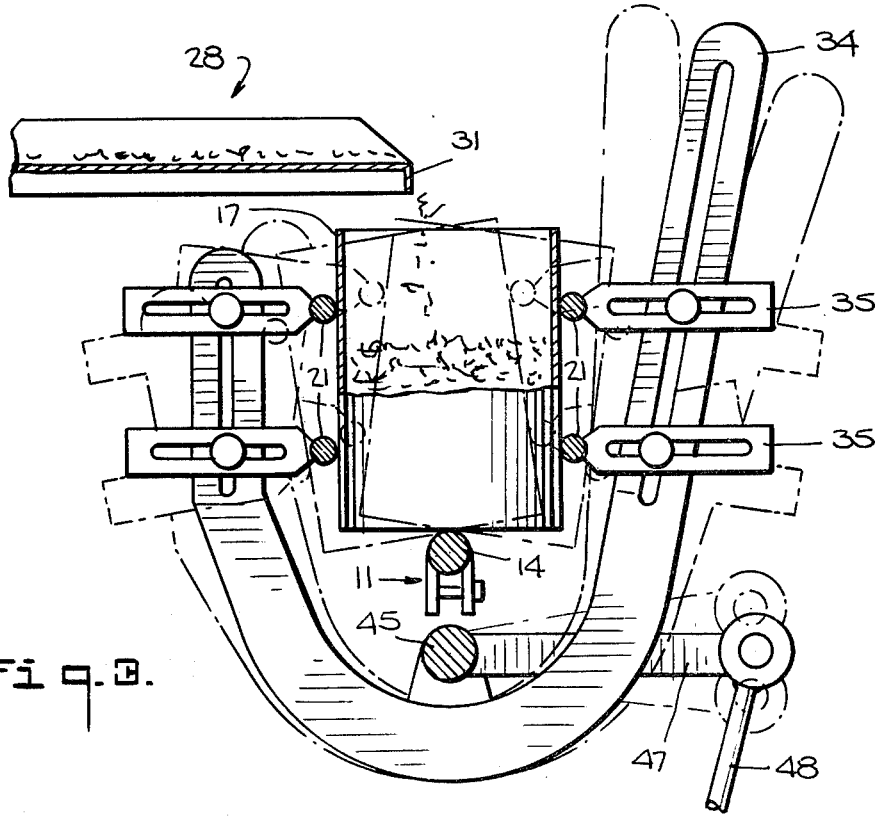
Fig. 3.

41
36
37
40
39
31
29
28
20
11
32
14
16
57
56
58
58a
22
24
38
61
60
59

OPEN-TYPE FILLING MACHINE

BACKGROUND OF THE INVENTION

1. Field of the Invention

This invention relates to machines and methods for filling containers moving in a line and particularly to machines and methods for filling a line of moving containers with relatively small pieces of material, specifically material such as vegetables, fruit, and other food items.

2. Description of the Prior Art

My U.S. Pat. No. 3,903,941, issued Sept. 9, 1975, and my U.S. Pat. No. 3,905,326, issued Sept. 16, 1975, disclose machines which are adapted to deliver a flow of food material to containers or other receiving areas as they move in a line. The disclosures of these patents are incorporated herein by reference.

The machine of U.S. Pat. No. 3,905,326 is particularly adapted for evenly spreading particulate or shredded food materials onto the tops of individual receiving items, such as pizza pies. The machine of U.S. Pat. NO. 3,903,941 is intended for general purpose food packing and handles small food items such as fruit, cut or sliced vegetables, and so forth.

Both the product spreading machine and the general packing machine of these U.S. patents are so-called drum-type fillers. In these machines, the food materials are delivered to the interior of an open-ended drum surrounding the container conveyor with the drum axis extending generally in the direction of the path of travel of the containers on the conveyor. The drum is supported for rotation about its axis and is rotated by means of a suitable drive. Buckets or scoops spaced circumferentially around the inside of the drum pick up portions of the material in the bottom of the drum as it rotates and carry the portions to the top of the drum, where the material is released onto a shaker tray for delivery into the containers.

The rotating drum arrangement provides a simple, gentle means for lifting portions of the product from a reserve supply below the path of travel of the containers up to delivery means above the path of travel of the open tops of the containers. The portions of material are distributed substantially uniformly in each bucket along the length of the drum parallel to the conveyor line. When these portions are delivered to a shaker tray which is positioned above the open tops of the containers in the filling zone and is mounted for reciprocal motion in a direction transverse to the line of containers, a uniform distribution of material parallel to the line of containers is maintained. Upon reciprocation of the shaker tray, the material proceeds laterally across the pan and falls over a discharge edge extending parallel to and above the line of containers, the flow of materials over the edge being substantially uniformly distributed along its length.

Despite their many advantages, the rotating drum machines can be difficult to clean and service. The reason for this is that much of the machinery is inside the drum and consequently it is necessary to have access to the inside of the drum for effective maintenance and cleaning. This means removing the cylindrical jacket of the drum and subsequently reinstalling it.

Solbern Corp. of Fairfield, N.J. heretofore has marketed a so-called open-type filling machine for packing pickles into open-top jars. The machine bears the name "High Speed Open-Type Pickle Packer." In this special purpose machine, pickles are delivered to a hopper located near the output end of the machine below and to one side of the container conveyor. A continuous moving belt conveyor carries pickles from the hopper and upwardly along an incline in a direction opposite to the movement of the line of containers through the filling zone. The pickles are discharged from the top of the inclined conveyor onto another moving belt conveyor extending laterally adjacent the input end of the machine above the line of containers. From the second moving belt conveyor, the pickles drop to a third conveyor extending upwards and in the same direction as the line of containers proceeding through the filling machine. The third conveyor terminates in a horizontal portion extending through the filling zone of the machine. Paddle-like rake blades mounted on a transversely moving endless belt above the end of the third conveyor move across the conveyor and push the pickles off the edge onto a vibrating shaker pan. The shaker pan then delivers pickles to the line of jars below the shaker pan in a manner similar to that described for the drum-type fillers.

Any pickles which fail to enter the open tops of the containers drop to still another endless belt conveyor running parallel to and below the line of containers to the outlet end of the machine. There, the returning pickles drop onto a fifth belt conveyor extending transversely back to the hopper. Thus, the open-type pickle packing machine provides a loop of five moving belt conveyors, each successive conveyor extending at right angles to the line of travel of the previous conveyor. All of the conveyors are open and accessible for simple and convenient maintenance and cleaning; however the number of belt conveyors increases the complexity of the machine and the floor space required for the machine.

SUMMARY OF THE INVENTION

The present invention comprises an open-type filling machine for general food packing and canning purposes which is compact and easy to clean and maintain. In general, the invention comprises a machine and method for filling containers to a preselected level. The machine of the invention is of the type that has a longitudinal axis with an input end and an output end and includes an elongated moving conveyor member for conveying containers along a linear path parallel to the longitudinal axis of the machine from the input end through a filling region to the output end.

As in the prior machines, a horizontal shaker pan is mounted above the conveyor member in the filling zone for reciprocal motion transverse to the linear path of the containers. The shaker pan has a free edge portion extending substantially parallel to the linear path for discharging material into containers moving along the path in the filling zone. Means are provided for shaking the containers in the filling zone to facilitate the settling of material more closely into the containers and to eject excess material. In addition, there is a hopper positioned below the level of the moving conveyor member adjacent to the outlet end of the machine and an inclined conveyor having a lower end within the hopper and an upper end above the level of the shaker pan. The inclined conveyor extends from the output end toward the input end of the machine.

The improved features of the present invention comprise simple and compact means for delivering material from the inclined conveyor to the shaker pan that are easily accessible for maintenance and cleaning. These delivery means include an additional horizontal shaker pan positioned underneath the upper end of the inclined conveyor and above the first shaker pan. The additional shaker pan, which is mounted for reciprocal motion parallel to the linear path of travel of the containers, has a discharge edge portion that extends diagonally above the full width of the first shaker pan. Thus, the discharge edge portion extends from adjacent the portion of the first shaker pan nearest to the output end of the machine to adjacent the portion of the first shaker pan nearest to the input end of the machine.

The provision of a single intermediate shaker pan between the inclined conveyor and the final shaker pan permits a simplified and highly compact design of the filling machine in which all elements are easily accessible. The diagonal discharge edge portion of the intermediate shaker pan effectively serves to distribute the materials in a uniform manner across the first shaker pan which is moving transversely to the line of containers. In this way the material is caused to change its direction of movement by approximately 90° as the material drops from the intermediate shaker pan onto the first shaker pan.

In accordance with the present invention the provision of spaced flights extending above the surface of the inclined moving belt conveyor permits the use of a steeper incline for a more compact arrangement and insures that material in the hopper is picked up and distributed uniformly across the width of the conveyor belt.

Another novel feature of the present invention is a flapper plate hinged for pivoting movement about an axis parallel to the cross-axis of the conveyor belt near its lower end. The flapper plate has an edge that is adapted to rest against the upward facing surface of the belt so that the plate can block the downward passage of materials into the bottom of the hopper. At the same time, the hinged flapper plate will swing upward to allow passage of each successive transverse barrier on the upwardly moving belt.

For returning excess material from the filling region back to the reservoir container, the machine of the present invention uses a simple shaker trough mounted underneath the line of containers and having an outlet with a discharge edge positioned over the reservoir container. The trough is mounted for reciprocal movement along its longitudinal axis to implement the movement of spilled material back to the reservoir.

BRIEF DESCRIPTION OF THE DRAWINGS

FIG. 2 is a fragmentary plan view, in simplified form, of the filling zone of the machine of FIG. 1, showing the directions of flow of material from the upper end of the inclined conveyor to the line of containers.

FIG. 3 is a fragmentary vertical section view looking along the line of containers from the input end of the machine and showing the means for guiding and shaking the containers in the filling region.

DESCRIPTION OF THE PREFERRED EMBODIMENTS

Figure 1:
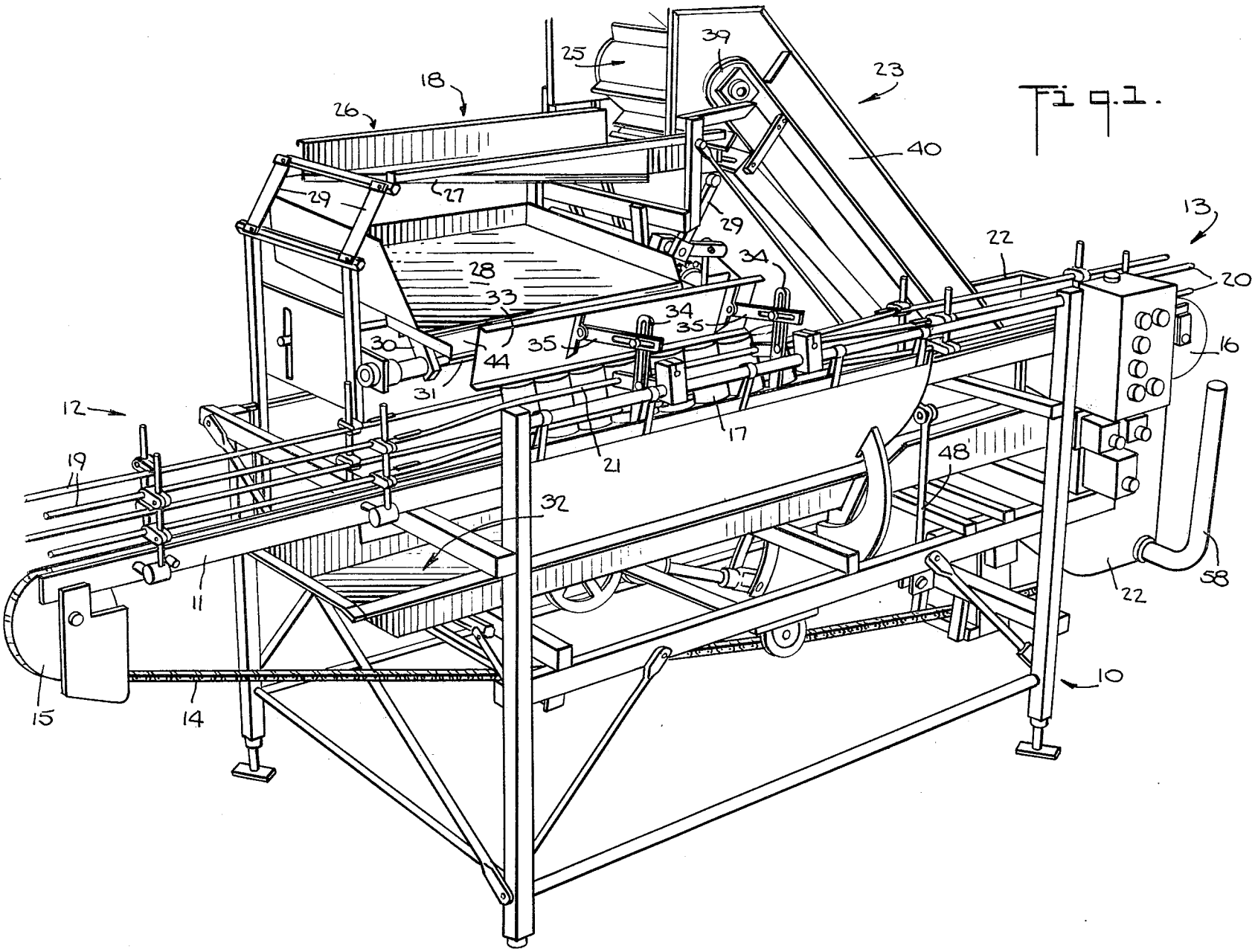
FIG. 1 is an overall perspective view of the filling side of the machine of the present invention, looking at the input end for the line of moving containers.

With reference to the drawings, FIG. 1 shows a perspective view of the filling side of the preferred embodiment of an open-type filling machine according to the present invention.

In the machine, an oblong open structural frame 10 supports an elongated guide channel 11 that extends from the container entrance or input end 12 to the container exit or output end 13 of the machine and defines the longitudinal axis of the machine. Guide channel 11 supports an elongated moving conveyor member in the form of an endless articulated cable 14 which passes over grooved pulleys 15 and 16 at the input and output ends, respectively. The cable is jacketed with resin material in order to provide a resilient friction surface for engaging the bottom portions of the containers.

A line of containers 17 is carried on the support member 14 through a filling zone 18 of the machine. At the entrance end, the containers are guided and supported by stationary side rails 19 which are adjustably connected to the guide channel 11. Similar side rails 20 are provided at the exit end of the machine. In the filling zone, a set of moving side rails 21 guide the containers and rock them with respect to an adjustable preselected nominal tilted position by means that will be further described below in connection with FIG. 3.

At the output end of the machine, a hopper 22 is positioned below the level of the moving conveyor member 14. An inclined conveyor 23 extends upward from the hopper in a direction opposite to the direction of movement of the containers on the moving conveyor member. The inclined conveyor has a lower end 24 (shown in FIG. 6) and an upper end 25 adjacent to the downstream end of the filling zone. An intermediate shaker pan 26 is positioned below the upper end of the inclined conveyor to receive material discharged therefrom. Shaker pan 26 has a discharge edge 27 that extends diagonally above a rectangular shaker pan 28.

Shaker pan 26 is pivotally mounted on parallelogram flexured legs 29 for reciprocal motion in a direction parallel to the longitudinal axis of the machine. Legs 29 can be formed from strips of laminated resin material. Since the shaker pan 26 is slightly elevated as it is driven to the left, as shown in FIG. 1, material on shaker pan 26 is moved to the left. Shaker pan 28 is pivotally mounted on similar parallelogram flexural legs 30 for reciprocal motion in a direction transverse to the longitudinal axis of the machine. Shaker pan 28 has a discharge edge 21 extending parallel to and above the line of containers for delivering material into the containers. Since shaker pan 28 is slightly elevated as it moves toward the line of containers, material on shaker pan 28 is advanced toward the containers. Any excess material which does not enter the open tops of the containers drops down into a shaker trough 32, which extends beneath the moving support member and delivers the spilled material back to the reservoir container.

A baffle 33 which is adjustably mounted on the upper ends of J-shaped support members 34 (see FIG. 3) by means of slotted bars 35 guides material delivered over the discharge edge of shaker pan 28 into the open tops of containers 17. Since the J-supports 34 form part of the container tilting and shaking mechanism, as will be described below with reference to FIG. 3, baffle 33 moves laterally with the containers as they are shaken or when the tilt angle of the containers is adjusted. In this way it is possible for the baffle to deflect material into the containers without requiring adjustment of the baffle supports for every change in tilt angle.

One of the principal improvements provided by the apparatus of the present invention is the simplified arrangement for transferring materials delivered from the upper end of inclined conveyor 23 to shaker pan 28 while maintaining a uniform distribution of material on shaker pan 28. This arrangement is illustrated in FIG. 2 which shows successive lines of materials uniformly distributed above flights 36 which are spaced longitudinally along the upper surface of an upwardly moving conveyor belt 37.

Figure 4:
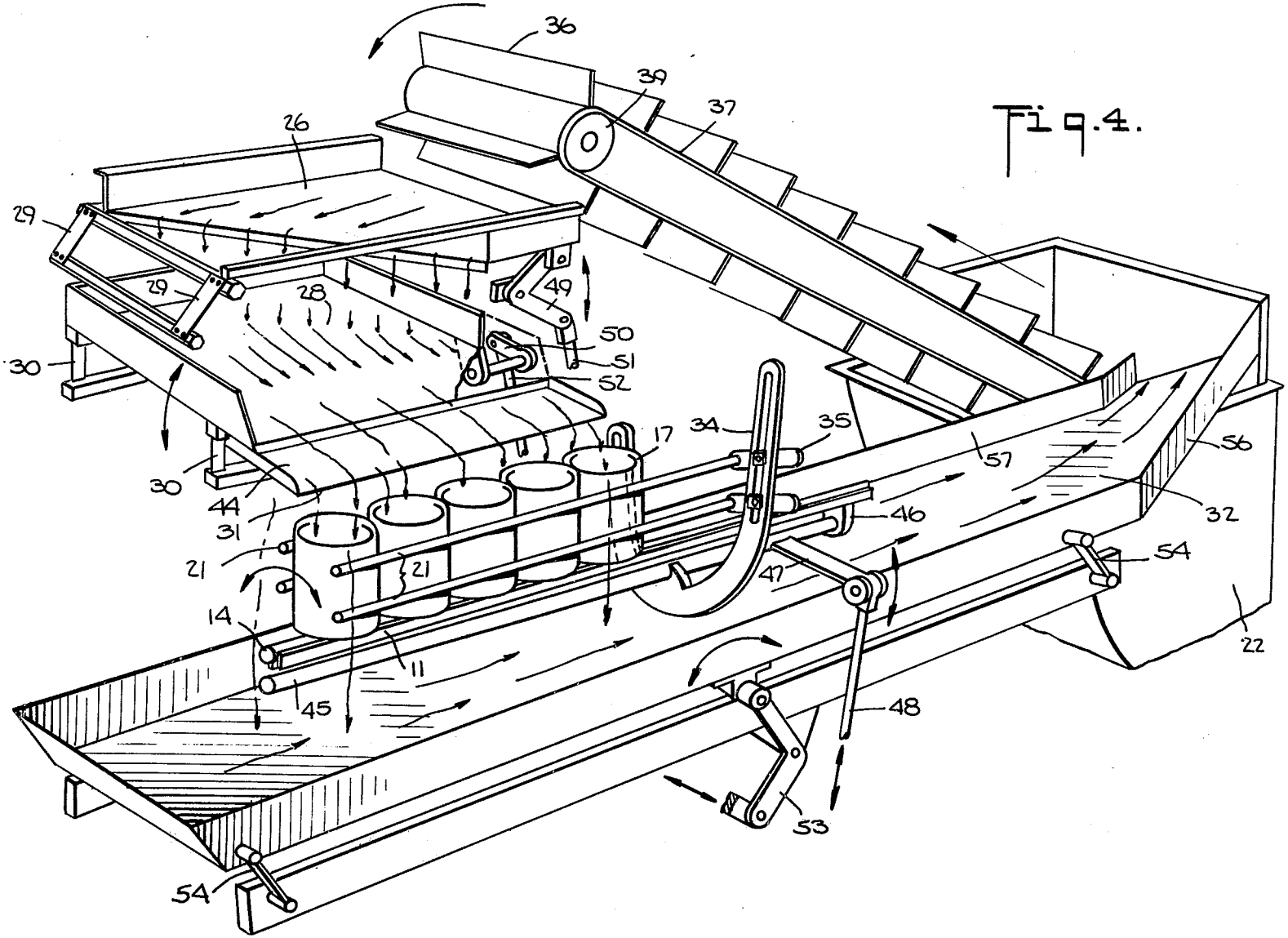
FIG. 4 is a fragmentary perspective view in mechanical schematic form of the filling side of the machine, looking at the input end and showing only the material conveying elements of the machine.
Figures 5, 6:
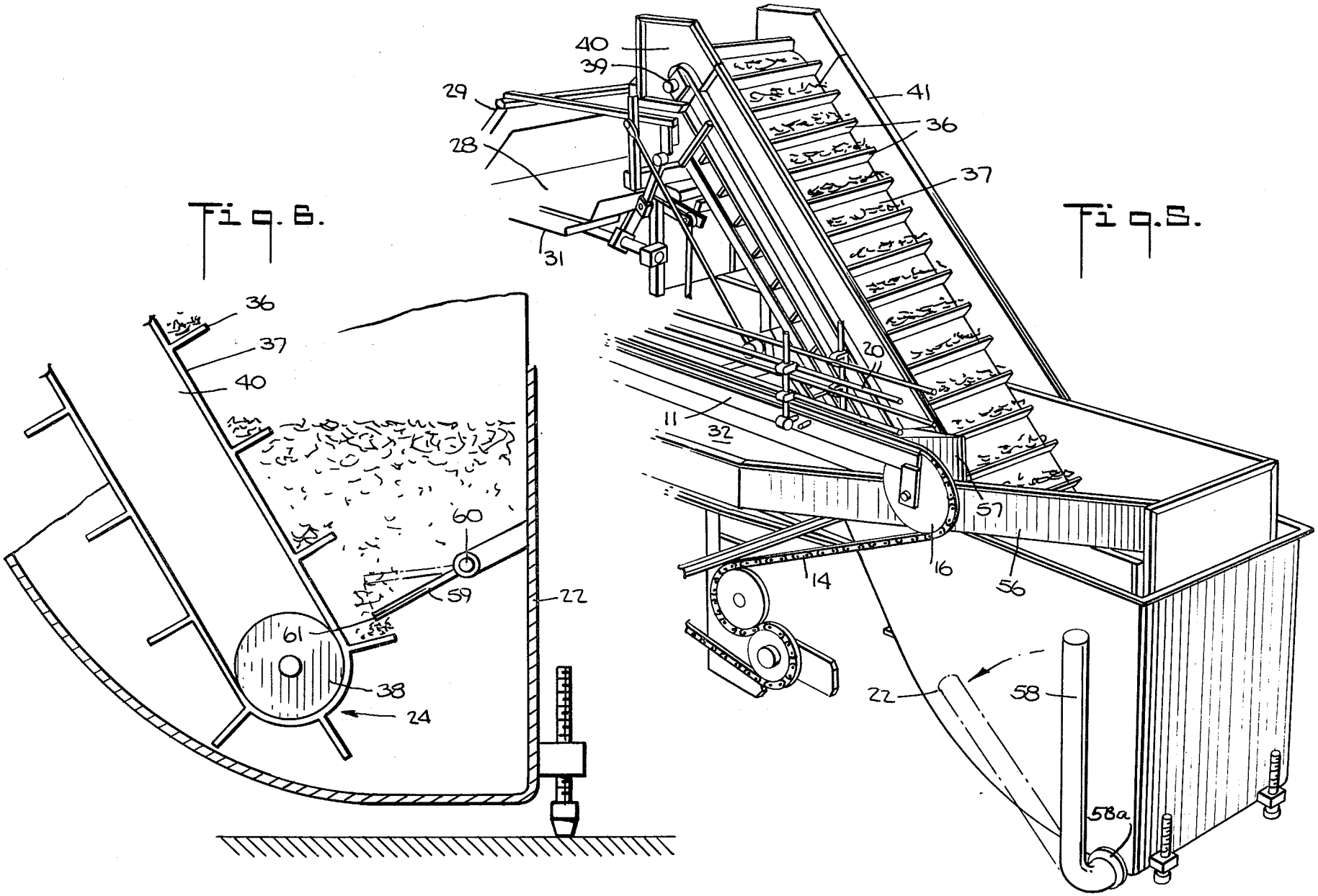
FIG. 5 is a fragmentary perspective view of the filling side of the machine of FIG. 1, looking at the output end.
FIG. 6 is a fragmentary vertical section of the reservoir container in mechanical schematic form, looking from the filling side of the machine and showing the flapper plate arrangement.

As shown in FIG. 6, the conveyor belt 37 is an endless belt that passes around a first roller (idler roller) 38 at the lower end of the conveyor and a second roller (drive roller) 39 at the upper end of the conveyor (see FIG. 4). The rollers are mounted between longitudinal side plates 40 and 41, which are spaced apart by a distance to provide close working clearance between their inner faces and the adjacent side edges 42, 43 of the belt (FIG. 5).

As each flight 36 of the belt passes over the drive roller at the upper end 25 of the conveyor, the uniformly distributed line of material in front of the flight drops onto the surface of triangular shaker pan 26 (FIG. 2). As pan 26 oscillates in a direction parallel to the longitudinal axis on the machine, each successive row of material deposited on the shaker pan moves in the direction of the arrows with the individual pieces in each row spreading out into a substantially even layer over the surface of the pan. The flow of material over the shaker pan surface is unidirectional because the parallelogram flexural legs are angled to provide an upward component to the forward movement (in the direction of the arrows) and a downward component to the rearward movement of the tray (opposite to the direction of the arrows) as is conventionally done in shaker pan design.

The moving layer of material on shaker pan 26 cascades in a uniform stream over the diagonal discharge edge 27 and distributes itself evenly across the width (parallel to the longitudinal axis) of rectangular shaker pan 28. This uniform layer then moves laterally in the direction of the arrows to cascade over discharge edge 31 into the open containers passing through the filling region below pan 28. Pan 28 is equipped with an extendable shelf 44 (FIGS. 1 and 2) to permit adjustment of the location of discharge edge 31 relative to the vertical plane of moving support member 14 as determined by the size of containers 17 and the tilt angle, if any.

Any excess material falling past the containers or ejected from them during tilting and shaking drops down into shaker trough 32 which moves the material in the direction of the arrows shown in FIG. 2, back to the hopper 22.

The tilting and shaking part of the apparatus is shown more clearly in FIG. 3, which is a view of the line of containers in the filling zone looking toward the outlet end of the machine. As can be seen from the drawing, guide rails 21 can be adjustably positioned to support various sizes of containers by means of slotted bars 35, which are bolted to each J-support 34. The J-support, in turn, is clamped to a shaft 45 by any suitable arrangement (not shown), the shaft being rotatably mounted below guide channel 11 in bearing blocks 46 (see FIG. 4). A crank arm 47 is attached at one end thereof to the shaft 45 by suitable means (not shown) and at the other end thereof is connected by a connecting rod 48 to a suitable eccentric drive (not shown) which reciprocates connecting rod 48 vertically. Examples of suitable clamping arrangements and eccentric drives are illustrated in my U.S. Pat. No. 3,903,941, referred to above.

Since the eccentric drive imparts a reciprocating motion to connecting rod 47, there is produced a rocking oscillatory movement of crank arm 46, shaft 45, and J-bars 34, between limits shown by the dashed lines of FIG. 3. This oscillatory motion, in turn, causes the containers to rock laterally on support member 14, thus shaking down the material entering the containers while ejecting any excess material.

In the arrangement shown in FIG. 3, the tilt angle of the containers can be adjusted by means of the lateral positioning of guide rail bars 35. Adjustment is also possible through the clamping means of the J-support 34 or the crank arm 46. Still another alternative is to vary the length of connecting rod 47. On the other hand, the shaking amplitude can be adjusted by changing the degree of eccentricity of the eccentric drive (not shown) for connecting rod 48.

With reference next to FIG. 4, the material handling arrangement of the present invention is shown. As described previously, the materials are delivered to hopper 22 from whence they are carried in incremental portions by the flights 36 of conveyor belt 37 to the upper end 25 of the conveyor. From the conveyor, the materials are delivered successively to shaker pan 26 and shaker pan 28 before discharged onto the line of containers 17.

The shaker pan 26 is driven by crank arm 49 and connecting rod 51. The shaker pan 28 is driven by crank arm 50 and connecting rod 52. Each connecting rod is reciprocated by a drive (not shown), with the two drives being connected by either a common shaft or separate shafts, as desired. Return shaker trough 32 is also reciprocated by a drive (not shown) operating through a crank arm 53 to reciprocate the trough on parallelogram flexural legs 54. The resulting reciprocation of the shaker trough causes excess material to travel down the trough and return to the hopper 22.

In the preferred embodiment of FIG. 1, the return trough extends parallel to the machine axis and has a side-opening discharge edge. This is shown more clearly in FIG. 5 which is a view of the outlet end of the embodiment of FIG. 1. As shown, trough 32 terminates with a bevelled outboard side 56 which extends to the far end of the hopper. The inboard side 57 of the trough is cut short, leaving a gap through which the spilled material can discharge back into the reservoir.

Normally the material being filled into the containers is suspended in a liquid vehicle (syrup, juice, and so forth) in hopper 22 to protect the material from injury by contact of one item of material with another and to facilitate removal of the material from the hopper by conveyor 23. Hopper 22 is equipped with a standpipe 58 which can be tilted as shown in dashed lines in FIG. 5 to enable the level of liquid to be adjusted and to enable the hopper to be emptied of liquid. Clamp **58*a*** secures the standpipe in position.

An additional feature of the invention is shown in FIG. 6 which is a cross section of the hopper showing the lower end 24 of the inclined conveyor and a flapper plate 59. The plate 59 is mounted to pivot around a hinge pin 60 spaced from the upper surface of the conveyor belt and extending between the side plates of the conveyor. Flapper plate 59 has a free edge 61 that rests against the upper surface of the conveyor belt to keep the solid portion of the material in the hopper from passing downward between the belt and the hinge pin to the bottom of the hopper where it would be churned by the flights coming around the end of the conveyor without being picked up. At the same time, the flapper plate can be raised (as shown in dashed line position) to allow each flight 36 to pass by. Thus flapper plate 59 serves as a check valve and a guide to distribute material in uniform portions onto each transverse barrier as the conveyor belt moves upward.

Although either electric or hydraulic drives can be used for any or all of the drive functions of the machine, in the preferred embodiment, hydraulic motors are used to drive both the inclined conveyor and the container conveyor and also the container shaking mechanism. The speed of these motors can be easily and simply adjusted over a wide range merely by controlling the flow rate of hydraulic fluid, thus permitting the machine to be adjusted for a desired filling rate and in accordance with the requirements of the particular material being filled.

Electric motor drives can be used to power both shaker pans and the shaker return trough. These shaker devices may have any given shaking rate, for example about 600 oscillations per minute, and accordingly there may be no need for speed adjustments of these drives.

OPERATION OF THE INVENTION

To summarize briefly the operation of the invention, as illustrated by the preferred embodiment described above, material, such as a food product, in a hopper is picked up in discrete portions by spaced flights of an upwardly moving inclined flat conveyor. The use of the flights accomplishes two purposes. as compared with a plain flat belt. First, the flights distribute the product relatively uniformly across the width of the conveyor and, secondly, the flights allow the conveyor to have a steeper incline and thereby occupy less floor space for a given rise.

From the upper end of the conveyor, the product falls onto an intermediate shaker pan, cascades over a diagonal edge of the intermediate pan onto a final shaker pan, and cascades over an edge of the final pan parallel to the container conveyor to drop into the open tops of a line of containers proceeding through the filling region. Excess product falls into a shaker trough and is directed back to the hopper.

Therefore, the filling machine of the present invention accomplishes a 90° turn of the product flow from the inclined conveyor to the final shaker pan by means of a single intermediate diagonal-edged shaker pan. In this way the invention provides the filling effectiveness of a drum type filling machine with the ease of access of an open type filling machine.

From the foregoing description and drawings it will be apparent that the apparatus of the present invention provides a compact, easy access filling machine of simple design, yet capable of a wide range of adjustments for handling a variety of material and container sizes at a wide range of filling rates.

What is claimed is:

1. A machine for filling containers to a preselected level, the machine having a longitudinal axis with an input end and an output end and including an elongated moving conveyor member for conveying containers along a linear path parallel to the longitudinal axis from the input end to the output end through a filling zone, and an approximately horizontal shaker pan mounted above the container conveyor in the filling region for reciprocal motion transverse to the linear path, the shaker pan having an edge extending substantially parallel to said linear path for discharging material into containers moving along the path in the filling region, a hopper positioned below the level of the container conveyor adjacent to the output end of the machine, an inclined product conveyor spaced from the container conveyor and moving in the opposite direction thereto, the inclined conveyor having a lower end within the hopper and an upper end above the level of said shaker pan, means for delivering product discharged from the upper end of the inclined conveyor to the shaker pan, and means for returning excess product from the filling zone to the hopper, wherein the improvement comprises:

said means for delivering product discharged from the upper end of the inclined conveyor to the shaker pan being an approximately horizontal intermediate pan having one edge portion positioned underlying the upper end of the inclined conveyor and above the level of said first-mentioned shaker pan and means for moving product discharged from the upper end of the inclined conveyor across the surface of the pan in approximately the direction of movement of said inclined conveyor, said intermediate pan having a discharge edge extending diagonally with respect to and overlying the first-mentioned shaker pan, whereby materials distributed from the inclined conveyor onto the intermediate pan transversely to the longitudinal axis are moved on said intermediate pan to fall over the diagonal edge thereof so as to be substantially uniformly distributed across the width of the first-mentioned shaker pan.

2. The machine of claim 1 wherein the inclined conveyor comprises:

a first transverse roller rotatably mounted at the lower end of the conveyor;

a second transverse roller rotatably mounted at the upper end of the conveyor;

a flat endless moving belt passed around the first and second rollers, the belt having a plurality of spaced flights extending transversely across the width of the outward facing surface of the belt, the flights being adapted to pick up and distribute substantially uniformly across the width of the belt separate portions of loose product material contained in the hopper as the belt moves upward through the hopper toward the upper end of the conveyor.

3. The machine of claim 2 wherein the conveyor further comprises a flapper plate 59 positioned at the lower end of the conveyor for pivotal movement about an axis parallel to the axis of the first roller and spaced from the upward facing surface of the conveyor belt, the flapper plate having an edge spaced from the pivotal axis and adapted to rest against the upward facing surface of the belt, whereby the flapper plate is adapted to block the downward passage of materials in the hopper between the conveyor belt and the pivot axis and to swing upward to allow a passage upward of each flight on the belt.

4. The machine of claim 1 wherein the means for returning excess product material to the hopper comprises an elongated shaker trough mounted for reciprocal longitudinal movement and extending underneath the container conveyor, the trough having an outlet with a discharge edge positioned over the hopper.

5. The machine of claim 1 comprising means for shaking the line of containers in the filling zone to pack the product more closely in the containers and to eject excess product from the containers.

6. The machine of claim 5 comprising means for tilting the line of containers on the container conveyor in the filling zone to an angle corresponding to a preselected fill level.

7. The machine of claim 6 comprising a baffle connected to the means for tilting the line of containers for movement therewith, the baffle extending parallel to the longitudinal axis of the machine and being adjustably positioned to guide the product discharged from the first-mentioned shaker pan into the line of containers in the filling zone.

8. The machine of claim 1 wherein the intermediate pan is an additional shaker pan mounted for reciprocal motion in a direction approximately parallel to the direction of movement of the inclined conveyor, and the means for moving product across the surface of the pan comprises means for reciprocating the additional pan with an upward component of motion in the direction of movement of the inclined conveyor and with a downward component of motion in the reverse direction.

9. A method for delivering a solid particulate product to a line of containers moving in a linear path from an input end to an output end of a filling zone that extends for a predetermined distancce along the linear path, the method including raising portions of the product on an inclined upwardly moving surface from a lower level below the level of the bottoms of the line of containers at a location adjacent to the output end of the filling zone to an upper level above the level of the tops of the line of containers, the inclined surface being spaced from the linear path and moving in a direction opposite to the movement of the line of containers, discharging product from the moving inclined surface over an edge at the upper level perpendicular to the direction of movement of the inclined surface, delivering the product discharged from the inclined surface over said edge to an approximately horizontal surface positioned below the upper level of the inclined surface and having a discharge edge extending approximately parallel to and adjacent to the line of containers above the tops thereof through the filling zone, and shaking said approximately horizontal surface in a direction transverse to the line of containers in a manner to urge the product across said surface toward and over said discharge edge into said containers, wherein the improvement comprises said step of delivering the product discharged from the inclined surface to said approximately horizontal surface including:

discharging the product from the inclined surface over said edge at the upper level onto an intermediate approximately horizontal surface underlying said edge and having a discharge edge extending diagonally with respect to and overlying said first-mentioned horizontal surface, urging the product across said intermediate surface in a direction approximately parallel to the direction of movement of the inclined surface, and cascading the product over the length of the diagonal discharge edge of the intermediate surface onto said first-mentioned horizontal surface to distribute the product uniformly across the width of the first-mentioned horizontal surface in a direction extending substantially parallel to the linear path of the containers.

10. The method of claim 9 wherein the step of urging the product across said intermediate surface comprises shaking said intermediate surface in a direction parallel to the direction of movement of the inclined surface in a manner to urge the product across said surface and over the diagonal discharge edge.

* * * * *

UNITED STATES PATENT AND TRADEMARK OFFICE

CERTIFICATE OF CORRECTION

PATENT NO. : 4,142,560
DATED : March 6, 1979
INVENTOR(S) : Bernard C. Eisenberg

It is certified that error appears in the above-identified patent and that said Letters Patent are hereby corrected as shown below:

Column 4, line 56, delete "21" and insert --31--

Column 6, line 37, after "before", insert --being--

Column 7, line 42, delete the period "." and insert a comma --,--

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*